US005704798A

United States Patent [19]

Portman et al.

[11] Patent Number: 5,704,798

[45] Date of Patent: Jan. 6, 1998

[54] APPARATUS FOR AUTOMATICALLY TERMINATING A SIGNAL

[75] Inventors: John R. Portman, Anaheim; Gerald Lester, Costa Mesa; Loi Ninh, Foothill Ranch; Gary Tillyer; John Newman, both of Mission Viejo, all of Calif.

[73] Assignees: Sony Corporation, Tokyo, Japan; Sony Transcom, Inc., Irvine, Calif.

[21] Appl. No.: 599,567

[22] Filed: Feb. 9, 1996

[51] Int. Cl.[6] ..... H01R 33/96

[52] U.S. Cl. ..... 439/188; 200/51.09

[58] Field of Search ..... 200/51.09, 51.11; 439/188

[56] References Cited

U.S. PATENT DOCUMENTS

| | | | |
|---|---|---|---|
| 4,119,818 | 10/1978 | Noschese | 200/51.09 |
| 4,389,551 | 6/1983 | Deibele et al. | 200/51.09 |
| 5,096,271 | 3/1992 | Portman | 312/7.2 |

OTHER PUBLICATIONS

Standard Products, Cherry Electrical Products, CE-1288 Rev A, Oct. 1992, p. 6.

*Primary Examiner*—Gary F. Paumen

*Attorney, Agent, or Firm*—Pasquale Musacchio; Jerry A. Miller

[57] ABSTRACT

A connector module for terminating a video signal for a monitor in an aircraft entertainment system is disclosed. The module includes a switch having a post that is movable between an extended position for terminating the video signal and a retracted position for enabling transmittance of the video signal through an output connector for the monitor. In addition, the module includes a lever rotatably attached adjacent to the output connector. The lever is rotatable to a terminating position wherein the lever is adjacent to the post to enable positioning of the post in the extended position. Further, upon attachment of the video cable to the output connector, the video cable contacts the lever to cause rotation of the lever against the post to move the post to the retracted position.

13 Claims, 5 Drawing Sheets

APPARATUS FOR AUTOMATICALLY TERMINATING A SIGNAL

FIELD OF THE INVENTION

This invention relates to in flight entertainment equipment and more particularly, to a terminator that is activated automatically.

BACKGROUND OF THE INVENTION

Many aircraft include entertainment systems which serve to entertain passengers during the course of an airline flight. Such systems include monitors for displaying motion pictures and other programming. The monitors are typically divided into zones of the aircraft cabin corresponding to first class, business class or others. As such, it is desirable to arrange the monitors in a daisy chain configuration. This enables the monitors to be controlled individually or in strings of monitors.

Each of the monitors in such systems include a connector module for enabling the monitors to be connected in a daisy chain configuration. Referring to FIG. 1, one type of connector module 10 is shown. The module 10 includes a wall 26 having input 12 and output 14 connectors for a power and control signal and input 16 and output 18 connectors for a video signal. The power and control input 12 and output 14 connectors and the video input 16 and output 18 connectors are coupled in a daisy chain configuration through a circuit board 24 (partially shown in dashed lines) in a well-known manner. A video cable is attached between the video output connector 18 and the video input connector of a next monitor. This occurs for each monitor in the daisy chain except for the last monitor, wherein a terminator is manually attached to its video output connector. The terminator serves to terminate the video signal so as to reduce or eliminate video signal reflections which degrade picture quality in the monitors. However, the video output connector may be located in a difficult to reach area of the aircraft cabin. This renders manual attachment of the terminator difficult to achieve and is also time consuming.

Therefore, it is an object of the present invention to provide apparatus for automatically terminating the video signal to avoid having to manually attach a terminator to the video output connector.

SUMMARY OF THE INVENTION

This invention relates to a connector module for terminating a video signal for a viewing element in an aircraft entertainment system, wherein the viewing element includes an output connector. In particular, the module includes a switch for terminating the video signal. The switch includes a post that is movable between an extended position for terminating the video signal and a retracted position for enabling transmittance of the video signal through the output connector. In addition, the module includes a lever rotatably attached adjacent to the output connector. In particular, the lever is rotatable to a terminating position wherein the lever is adjacent to the post to enable positioning of the post in the extended position. Further, the lever is rotatable to an unterminated position wherein the lever contacts the post to move the post to the retracted position.

In another of aspect of the present invention, the post is biased to move to the extended position. Further, upon attachment of the video cable to the output connector, the video cable contacts the lever to cause rotation of the lever against the post to move the post to the retracted position.

DETAILED DESCRIPTION OF THE INVENTION

Figure 1:
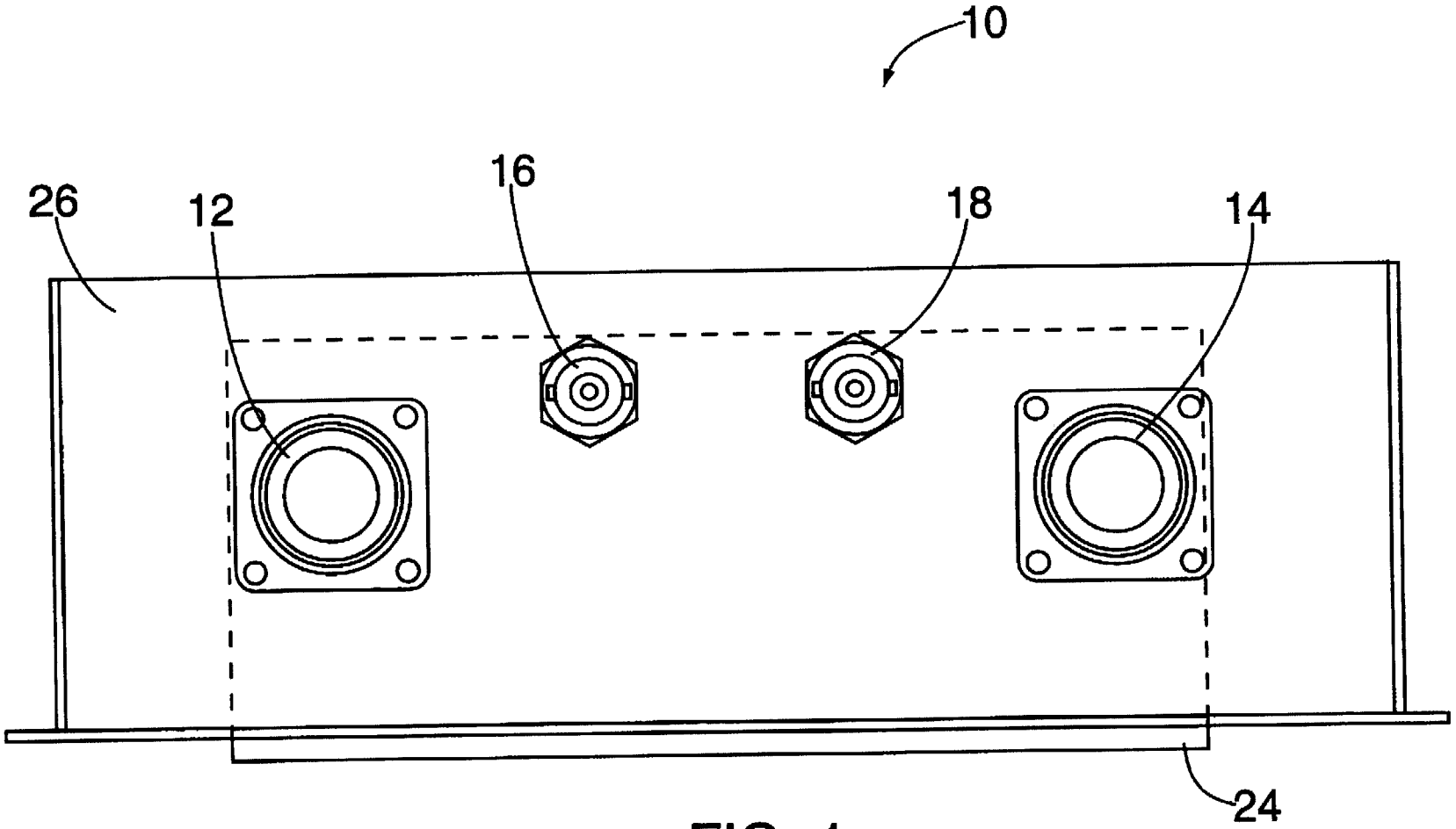
FIG. 1 PRIOR ART
FIG. 1 is a view of a conventional connector module.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiment shown and described. In the description below, like reference numerals are used to described the same, similar or corresponding parts in the several views of the drawings.

Figure 2:
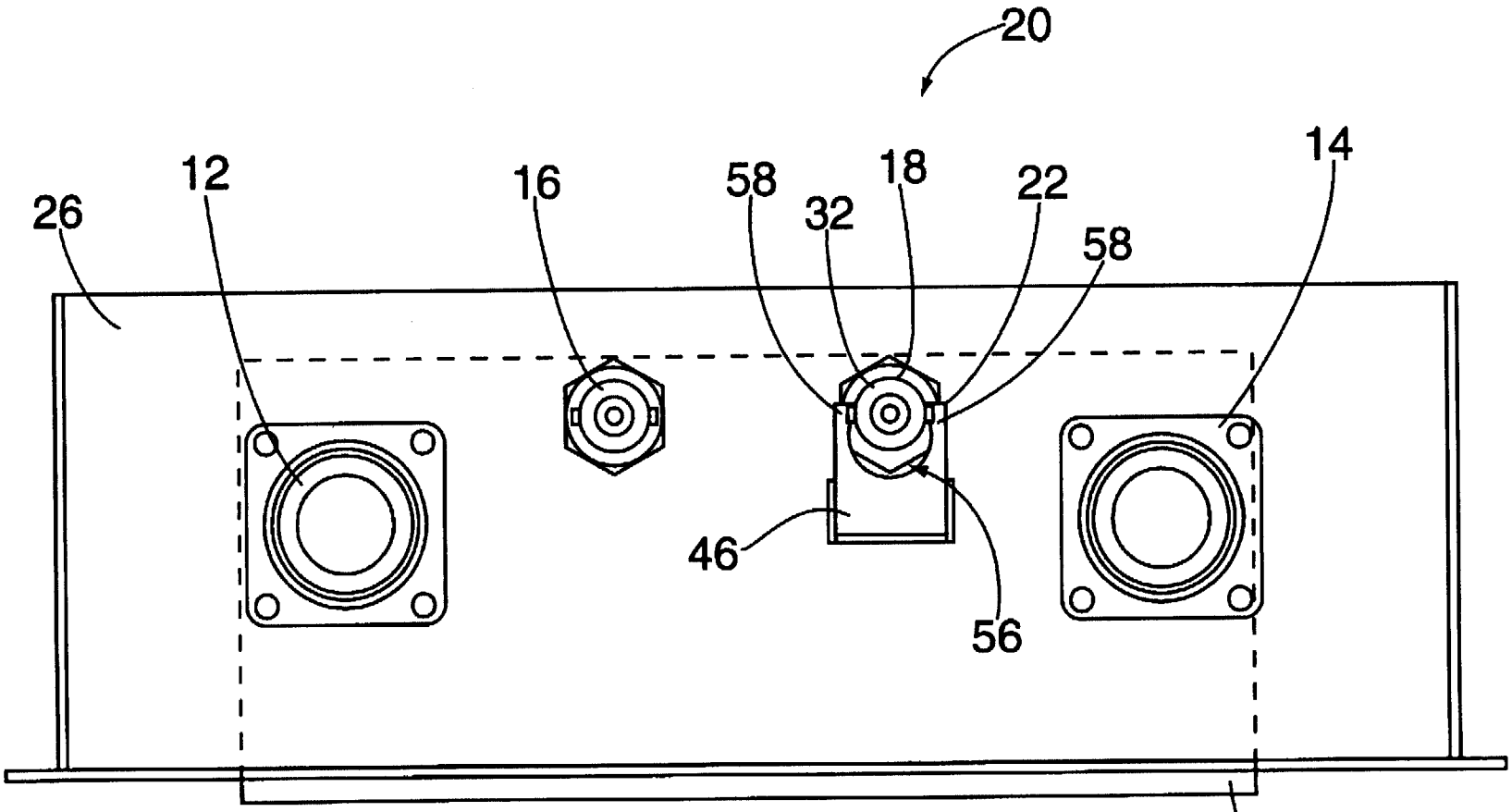
FIG. 2 is a view of a connector module which includes a lever in accordance with the present invention.

Many aircraft include entertainment systems which serve to entertain passengers during the course of an airline flight. Such systems include viewing elements such as monitors for displaying motion pictures and other programming. The monitors in such systems are arranged in a daisy chain configuration. In particular, each of the monitors include a connector arrangement for enabling the monitors to be connected in the daisy chain configuration. Referring to FIG. 2, a daisy chain connector module 20 that enables automatic termination of a video signal in accordance with the present invention is shown. The module 20 includes the power and control input 12 and output 14 connectors and the video input 16 and output 18 connectors. In accordance with the present invention, the video output connector 18 includes a first lever 22 for opening and closing a first terminator switch as will be described in relation to FIG. 3. The first lever 22 includes an upper contact section 46 having a cutout 56 to form a pair of contact members 58 which are spaced apart from each other. The video output connector 18 includes a mating portion 32 that extends through the cutout 56 and between the contact members 58 such that the contact members 58 are adjacent to the mating portion 32.

Figure 3:
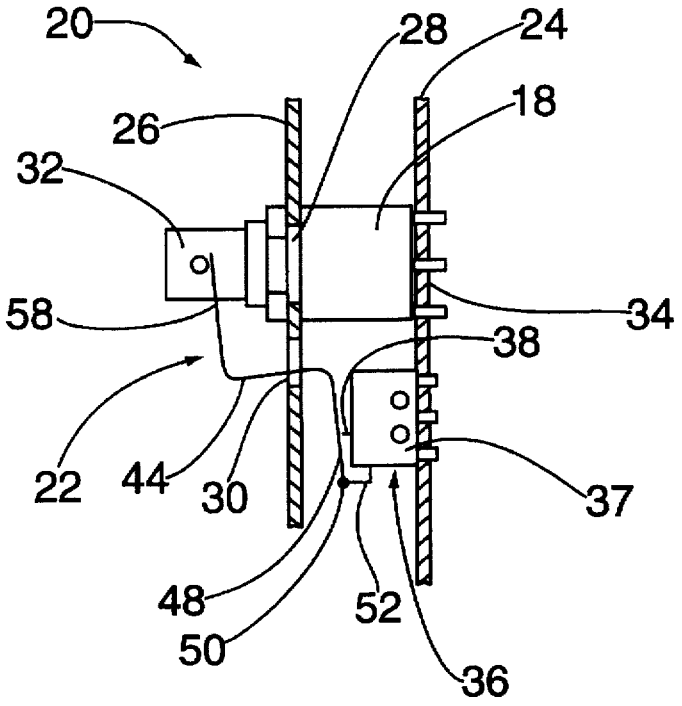
FIG. 3 is a cross sectional view of the module wherein a post of a switch is shown in an extended position.

Referring to FIG. 3, a partial cross sectional view of the module 20 is shown. The wall 26 includes first 28 and second 30 apertures. The video output connector 18 is mounted to the wall 26 such that the mating portion 32 extends through the first aperture 28. The video output connector 18 further includes a terminal portion 34 which is electrically connected to the circuit board 24. The circuit board 24 includes a first terminator switch 36 which is coupled to a resistor arrangement adapted to terminate the video signal in a well known manner. The first switch 36 may be a commercially available switch and includes a first switch body 37 and a post 38 that extends from the first switch body 37 toward the wall 26. The post 38 is biased to move from a retracted position, wherein the post 38 is partially retracted into the first switch body 37, to an extended position, wherein the post 38 is fully extended out from the first switch body 37. In FIG. 3, the post 38 is shown in the extended position. The first switch 36 is adapted to close when the post 38 is in the extended position. This causes the video signal to be transmitted through the resistor arrangement, thus terminating the video signal. Further, the first switch 36 is adapted to open when the post 38 is in the retracted position. This enables the video signal to be transmitted through the video output connector 18.

The first lever 22 includes a horizontal section 44 affixed between the upper contact section 46 and a lower contact section 48. The horizontal section 44 extends through the second aperture 30 and the lower contact section 48 is positioned adjacent to the post 38. The lower contact section 48 includes an annular portion 50 that is rotatably affixed to a pin element 52 that extends from the first switch 36 to enable rotation of the first lever 22. The second aperture 30 is of sufficient size to accommodate movement of the horizontal section 44 during rotation of the first lever 22. In a first position, the weight of the first lever 22 causes counterclockwise of the first lever 22 such that the upper contact section 46 is rotated away from the wall 26 and the lower contact section 48 does not contact the post 38. This enables the post 38 to move to the extended position, thus closing the first switch 36 and causing the video signal to be terminated through the resistor arrangement.

Figure 4:
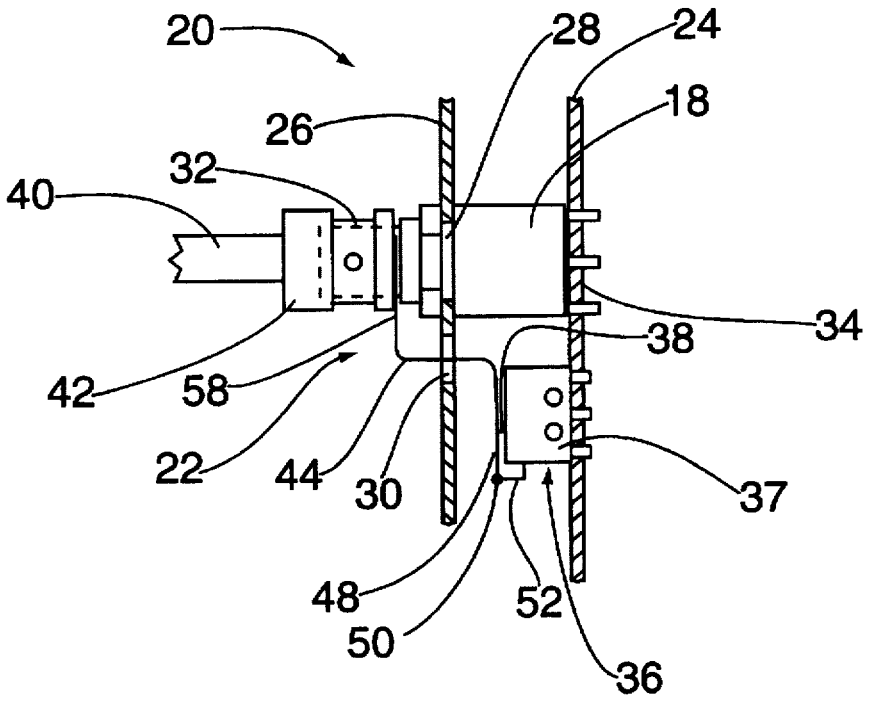
FIG. 4 is a cross sectional view of the module wherein the post is shown in the retracted position due to rotation of the lever against the post.

Referring to FIG. 4, a video cable 40 having a daisy chain connector 42 removably secured to the mating portion 32 is shown. An opposite end of the video cable 40 is attached to a video input connector of a next monitor in the daisy chain (not shown) in a well known manner. Referring to FIG. 2 in conjunction with FIG. 4, attachment of the daisy chain connector 42 to the mating portion 32 results in contact between the daisy chain connector 42 and the contact members 58. This causes clockwise rotation of the first lever 22 to a second position wherein the lower contact section 48 contacts the post 38 and moves the post 38 to the retracted position, thus biasing the post 38. This opens the first switch 36 and enables the video signal to be transmitted through the video output connector 18 and the video cable 40 to the next monitor in the daisy chain. Further, removably securing the daisy chain connector 42 to the mating portion 32 maintains the post 38 in the retracted position.

In accordance with the present invention, if a monitor is selected as the last monitor in the daisy chain, the daisy chain connector 42 is removed from the mating portion 32. This causes counterclockwise rotation of the first lever 22 into the first position. The post 38 then moves to the extended position, thus automatically terminating the video signal. Further, the daisy chain connector 42 may be re-attached, thus enabling the video signal to again be transmitted to the next monitor as previously described.

Figure 5:
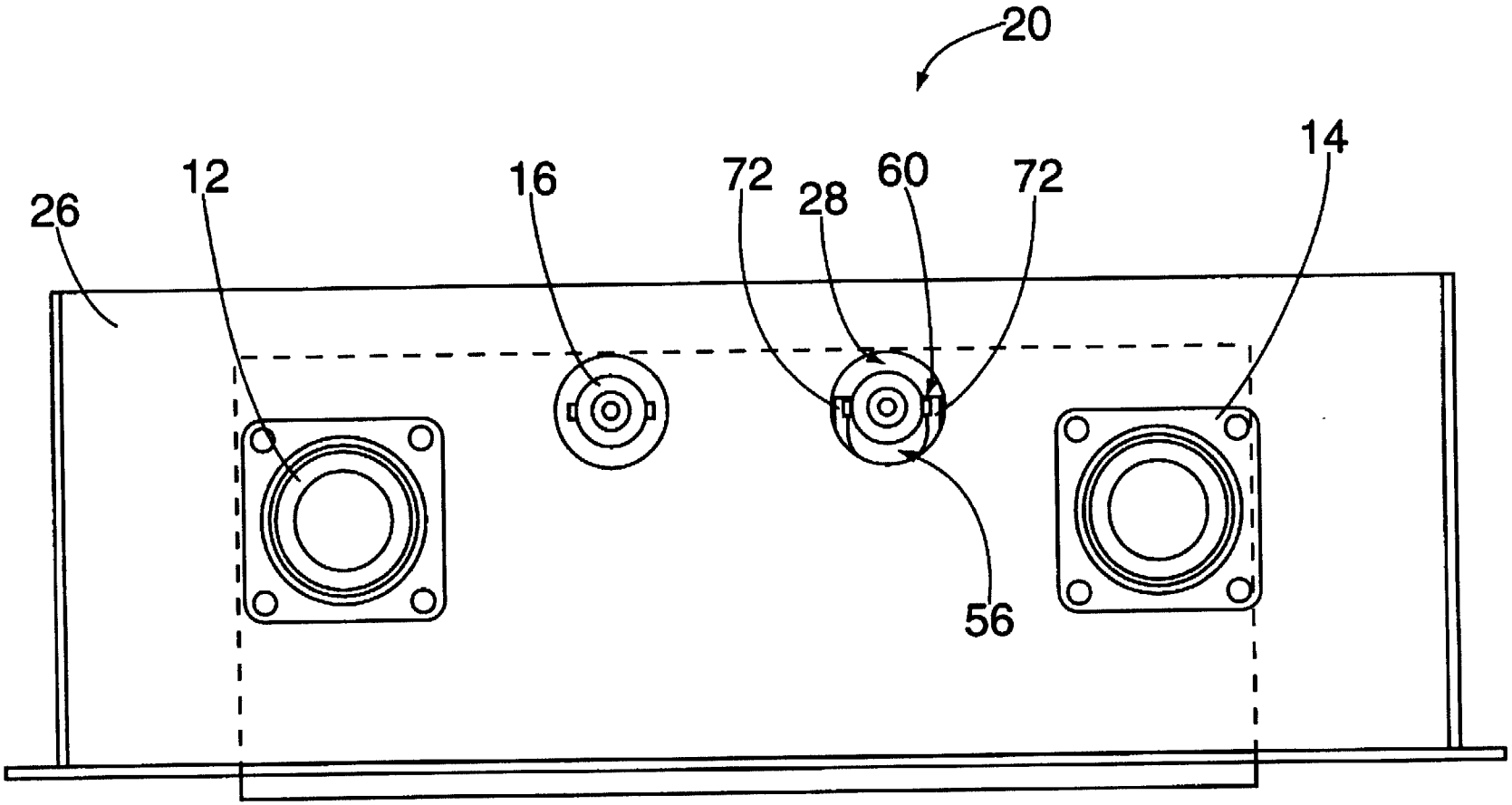
FIG. 5 is a view of an alternate embodiment of the connector module which includes a lever that is located within the connector module.
Figure 6:
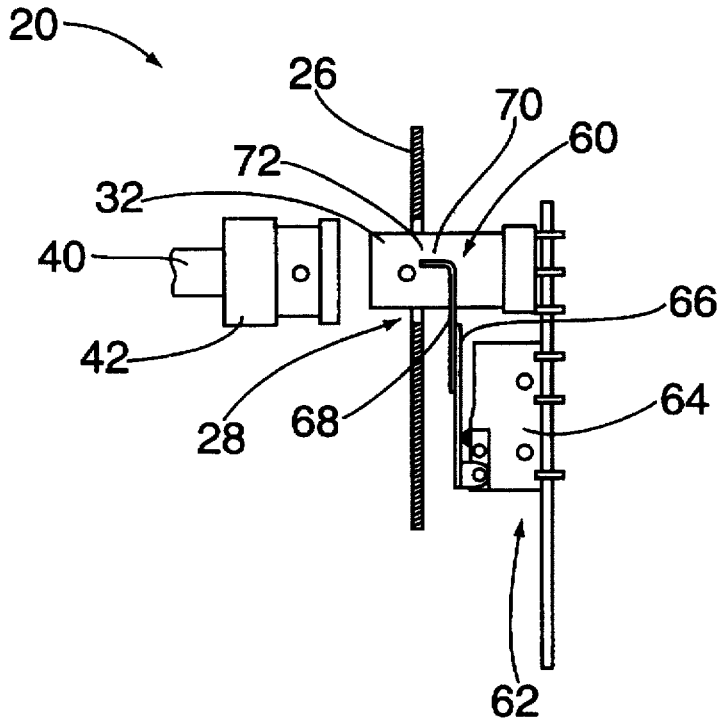
FIG. 6 is a cross sectional view of the alternate embodiment wherein the lever is shown in a terminated position.
Figure 7:
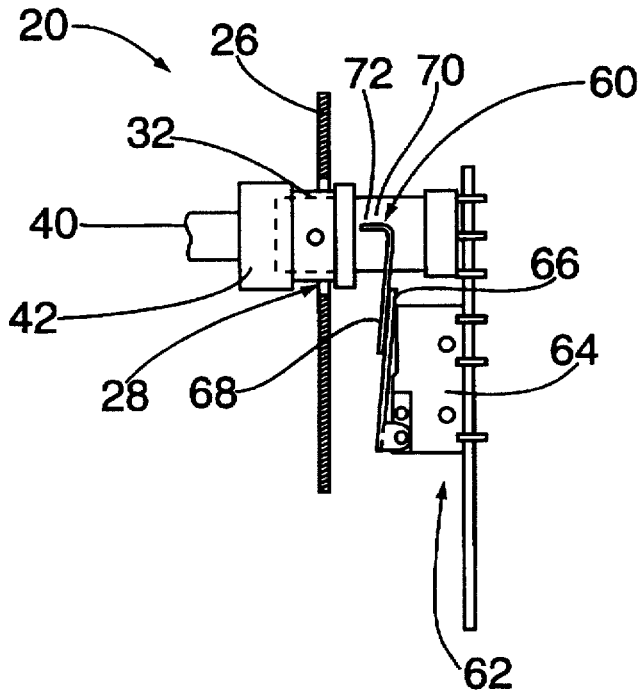
FIG. 7 is a cross sectional view of the alternate embodiment wherein the lever is shown in a non-terminated position.

Referring to FIGS. 5–7, an alternate embodiment of the present invention is shown. In this embodiment, a second lever 60 used to open and close a second terminator switch 62 is located behind the wall 26 within the connector module 20. The second switch 62 includes a second switch body 64 and an actuator arm 66 which is rotatably mounted to the second switch body 64. The actuator arm 66 may be rotated to a terminated position wherein the actuator arm 66 is spaced apart from the second switch body 64. Referring to FIG. 6, the actuator arm 66 is shown in the terminated position. Further, the actuator arm 66 may be rotated to a non-terminated position wherein the actuator arm 66 is moved toward and adjacent the second switch body 64. Referring to FIG. 7, the actuator arm 66 is shown in the non-terminated position. In addition, the actuator arm 66 may be biased to move to the terminated position from the non-terminated position. The second switch 62 is adapted to close when the actuator arm 66 is in the terminated position, thus terminating the video signal. Further, the second switch 62 is adapted to open when the actuator arm 66 is in the non-terminated position, thus enabling the video signal to be transmitted through the video output connector 18. The second switch 62 may be a commercially available switch such as that manufactured by the Cherry Corporation in Waukegan, Ill. and designated as model number DA3C-D1LB.

The second lever 60 includes a vertical portion 68 which is affixed to the actuator arm 66 and a horizontal contact portion 70 that includes the cutout 56 to form contact prongs 72 that extend toward the wall 26. The first aperture 28 is sized such that a portion of the cutout 56 and contact prongs 72 is accessible from outside the connector module 20. The second lever 60 is spaced apart from the second switch body 64 when the actuator arm 66 is in the terminated position. Upon attachment of the daisy chain connector 42 to the mating portion 32, contact occurs between the daisy chain connector 42 and the contact prongs 72. This rotates the actuator arm 66 to the non-terminated position to enable a video signal to be transmitted.

Thus, it is apparent that in accordance with the present invention, an apparatus that fully satisfies the objectives, aims and advantages is set forth above. While the invention has been described in conjunction with the specific embodiments, it is evident that many alternatives, modifications, permutations and variations will become apparent to those skilled in the art in light of the forgoing description. This includes the termination of signals other than video such as audio and radio frequency signals. Moreover, detection of whether or not the video cable is attached may be accomplished through the use of a light beam type photo detector, a radio frequency coupler or a capacitive circuit, each of which would require associated circuitry. Further, it is noted that the invention herein may be utilized to childproof a standard electrical wall outlet such as that found in a home by not supplying power to the outlet if the proper plug is not inserted. Accordingly, it is intended that the present invention embrace all such alternatives, modifications and variations as fall within the scope of the appended claims.

What is claimed is:

1. A connector module for terminating a video signal for a viewing element in an aircraft entertainment system, said viewing element having an output connector, comprising:

termination means for terminating said video signal, said termination means including a switch having a post extending therefrom, said post being movable between an extended position for terminating said video signal and a retracted position for enabling transmittance of said video signal through said output connector; and a lever rotatably attached to said switch and extending to adjacent said output connector, said lever being rotatable between a terminating position wherein said lever is adjacent said post and a non-terminated position wherein said lever contacts said post to move said post to said retracted position, wherein said lever is rotated to said non-terminated position due to contact between said lever and a video cable removably secured to said output connector.

2. The connector module according to claim 1, wherein said post is biased to move to said extended position.

3. The connector module according to claim 1, wherein said lever includes contact members for contacting said video cable.

4. The connector module according to claim 3, wherein said lever includes a lower contact section for contacting said post.

5. A connector module for terminating a signal for a viewing element in an aircraft entertainment system, said viewing element including an output connector that is attachable to a video cable for forming a daisy chain, comprising:

termination means for terminating said video signal, said termination means including a switch having a post extending therefrom, said post being movable between an extended position for terminating said video signal and a retracted position for enabling transmittance of said video signal through said output connector; and a lever rotatably attached to said switch and extending to adjacent said output connector, said lever being rotatable to a terminating position wherein said lever is adjacent said post to enable positioning of said post in said extended position, said lever being further rotatable to a non-terminated position upon attachment of said video cable to said output connector, wherein said video cable contacts said lever to cause rotation of said lever against said post to move said post to said retracted position.

6. The connector module according to claim 5, wherein said post is biased to move to said extended position.

7. The connector module according to claim 5, wherein said lever includes contact members for contacting said video cable.

8. The connector module according to claim 5, wherein said lever includes a lower contact section for contacting said post.

9. A method for terminating a signal for a viewing element in an aircraft entertainment system, said viewing element including an output connector, comprising the steps of:

providing a switch for terminating said video signal, said switch having a post extending therefrom, said post being movable between an extended position for terminating said video signal and a retracted position for enabling transmittance of said video signal through said output connector;

biasing said post to move to said extended position;

rotating a lever attached to said switch between a terminating position wherein said lever is adjacent said post and a non-terminated position wherein said lever contacts said post to move said post to said retracted position;

further including the step of attaching a video cable to said output connector to provide contact between said lever and said video cable to cause rotation of said lever to said unterminated position.

10. The method according to claim 9, further including the step of providing contact members for contacting said video cable.

11. The method according to claim 10, further including the step of providing a lower contact section for contacting said post.

12. A connector module for terminating a video signal for a viewing element in an aircraft entertainment system, said viewing element having an output connector, comprising:

termination means for terminating said video signal, said termination means including a switch having an actuator arm extending therefrom, said arm being rotatable between an extended position wherein said arm is spaced apart from said switch and a retracted position wherein said arm is moved toward said switch wherein when said arm is in said extended position, said video signal is terminated and when said arm is in said retracted position, said video signal is transmitted; and a lever element which includes a horizontal contact section having prongs adapted to contact a video connector, said lever element further including a vertical section affixed to said arm, wherein when said video connector is attached to said output connector, said video connector contacts said prongs to move said arm and said lever element to said retracted position and when said video connector is not attached to said output connector, said arm remains in said extended position.

13. The connector module according to claim 12, wherein said arm is biased to move to said extended position.

* * * * *